US007851734B1

(12) United States Patent
Hash et al.

(10) Patent No.: US 7,851,734 B1
(45) Date of Patent: Dec. 14, 2010

(54) ACCELERATION ACTIVATED FIN RELEASE MECHANISM

(75) Inventors: Gregory D. Hash, Orlando, FL (US); Adam J. Bojanowski, Oviedo, FL (US); Robert M. Hightower, Georgetown, TN (US); Gerry Lishin, Orlando, FL (US)

(73) Assignee: Lockheed Martin Corporation, Bethesda, MD (US)

( * ) Notice: Subject to any disclaimer, the term of this patent is extended or adjusted under 35 U.S.C. 154(b) by 784 days.

(21) Appl. No.: 11/842,647

(22) Filed: Aug. 21, 2007

(51) Int. Cl.
*F42B 10/18* (2006.01)

(52) U.S. Cl. ..... 244/3.27; 244/3.26; 244/3.24

(58) Field of Classification Search ..... 244/3.29, 244/3.28, 3.27, 3.26, 3.25, 3.24, 3.21
See application file for complete search history.

(56) References Cited

U.S. PATENT DOCUMENTS 3,347,491 A * 10/1967 Pickart ..... 244/3.27
3,819,132 A * 6/1974 Rusbach ..... 244/3.28
4,143,838 A 3/1979 Holladay
4,175,720 A 11/1979 Craig
4,600,167 A * 7/1986 Kastenhuber et al. ..... 244/3.28
6,880,780 B1 4/2005 Perry et al.
7,083,140 B1 8/2006 Dooley
7,104,497 B2 9/2006 Johnsson
7,207,518 B2 * 4/2007 Alculumbre et al. ..... 244/3.29

* cited by examiner

*Primary Examiner*—Tien Dinh
*Assistant Examiner*—Richard R Green
(74) *Attorney, Agent, or Firm*—Jeffrey D. Myers; Peacock Myers, P.C.; Timothy D. Stanley

(57) ABSTRACT

An acceleration activated fin release apparatus comprising a fin holder that when in latched state holds fins in a retracted position and a latching mechanism maintaining the fin holder in latched state until released by an acceleration event.

9 Claims, 3 Drawing Sheets

ACCELERATION ACTIVATED FIN RELEASE MECHANISM

CROSS-REFERENCE TO RELATED APPLICATIONS

Not Applicable.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

COPYRIGHTED MATERIAL

Not Applicable.

BACKGROUND OF THE INVENTION

1. Field of the Invention (Technical Field)

The present invention relates to deployment of fins on projectiles.

2. Description of Related Art

A guided projectile, as opposed to standard dumb projectiles, requires the use of tail fins to stabilize the round during flight. In order to limit storage space and gun barrel damage, it is important that the fins remain stowed until the projectile has effectively cleared all aspects of the gun tube. Typically the retention and release of these fins has been accomplished using electro-mechanical or pyrotechnic mechanisms that can be costly to install and time consuming to ruggedize to the gun blast environment and reduce overall system reliability.

A key in projectile design is the need to provide stable flight with precision accuracy. To accomplish this historically, those of ordinary skill in the art have utilized active canards as the primary control surfaces and tail fins for stabilization. The common problem with canards and fins is retention prior to gun launch and release after the projectile has left the gun tube. Where the canards typically have electro-mechanical devices inherent in their design, tail fins typically do not and often require additional weight in the form of electronics or even dangerous pyrotechnics in the tail/warhead section. Patents illustrative of the state of the art include U.S. Pat. No. 7,104,497, to Johnsson, U.S. Pat. No. 6,880,780, to Perry et al., U.S. Pat. No. 4,175,720, to Craig, and U.S. Pat. No. 4,143,838, to Holladay.

The present invention allows one to eliminate the expensive electronics and dangerous pyrotechnics needed in the tail/warhead section of the projectile by providing a reliable and purely mechanical means of retaining and releasing a projectile's fins.

While U.S. Pat. No. 7,083,140, to Dooley, uses a contact pawl system towards the rear of the fins, the present invention uses a non-contact pawl system at the front of the fins. Dooley's system requires a significant cut in the fin, significantly reducing fin strength, and the present invention does not. Dooley also utilizes the pawl to deflect the fins outward, whereas the present invention does not. The present invention is much more compact than Dooley's in that his device extends from in front of the fins to nearly the aft pivot pin location and the present invention is located only at the forward end of the fins. Furthermore, Dooley's system will only work with forward folding fins and the present invention can work with either forward or rearward folding fins.

BRIEF SUMMARY OF THE INVENTION

The present invention is of an acceleration activated fin release apparatus comprising: a fin holder that when in latched state holds fins in a retracted position; and a latching mechanism maintaining the fin holder in latched state until released by an acceleration event. In the preferred embodiment, the latching mechanism comprises a primary spring, most preferably a compression spring. The latching mechanism comprises one or more pawls and preferably one or more secondary springs each causing release of the one or more pawls upon the acceleration event. The fin holder comprises a ring comprising openings inside which tips of fins are held.

The present invention is also of a projectile comprising retractable fins that deploy on an acceleration event, comprising: a fin holder that when in latched state holds fins in a retracted position; and a latching mechanism maintaining the fin holder in latched state until released by the acceleration event. The preferred embodiment is as above.

The present invention is further of a method for acceleration activated fin release, comprising: holding fins in a retracted position with a fin holder in latched state; maintaining the fin holder in latched state with a latching mechanism; and releasing the latching mechanism with an acceleration event, thereby releasing the fins to a deployed state. Again, the preferred embodiment is as above.

Objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

The present invention provides a purely mechanical means of retaining and releasing fins in a guided projectile. Through the use of latches and one large compression spring, the mechanism remains locked in place to retain the fins during ground handling of the projectile. Additionally, during gun launch the mechanism keeps the fins locked in place until the projectile exits the barrel of the gun tube (here, the large setback acceleration seen during the gun launch compresses the large compression spring allowing the pawls to release and upon projectile exit from the gun tube the compression spring relaxes permitting the fins to release). This solution eliminates the costly use of electro-mechanical or pyrotechnic mechanisms and the need to ruggedize these mechanisms against the gun blast environment, thereby reducing cost and saving space/weight over conventional methods.

The embodiment of the invention shown in the figures is intended particularly for a 155 mm projectile. However, the invention operates in the same fashion for other sized guided projectiles.

Figure 1:
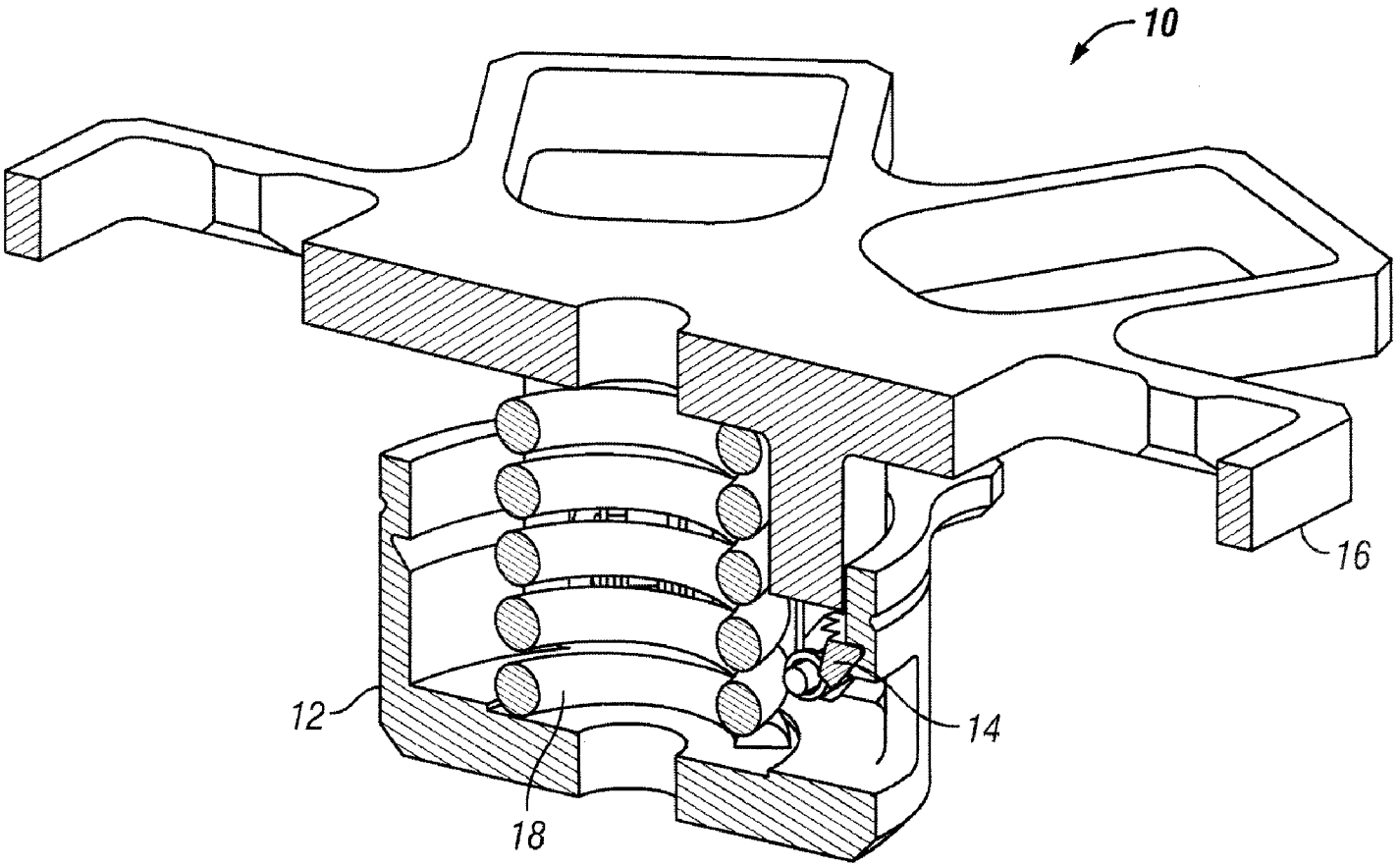
FIG. 1 is a perspective cut-away view of an apparatus of the invention.

FIG. 1 shows the apparatus 10 of the invention, comprising collar 12, pawl (latch) 14, lock ring 16, and spring 18. The preferred spring is a compression spring.

Figure 2:
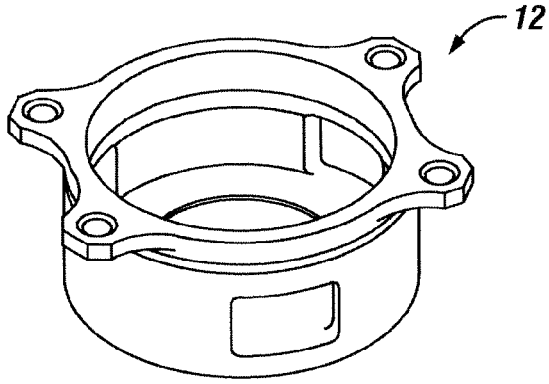
FIG. 2 is a perspective view of a collar of the invention.

FIG. 2 shows the preferred collar of the invention, which permits latching of the pawl and allows for modular assembly. The collar can be integral to the housing of the projectile.

Figure 3:
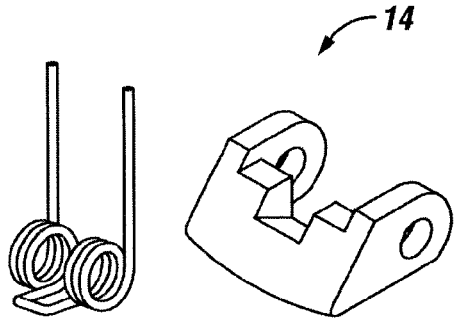
FIG. 3 is a perspective view of a pawl and spring of the invention.

FIG. 3 shows the preferred pawl (latch) of the invention, which holds the lock ring in position, preferably via torsion spring loading. One or more pawls may be employed, preferably in conjunction with a corresponding number of windows in the collar.

Figure 4:
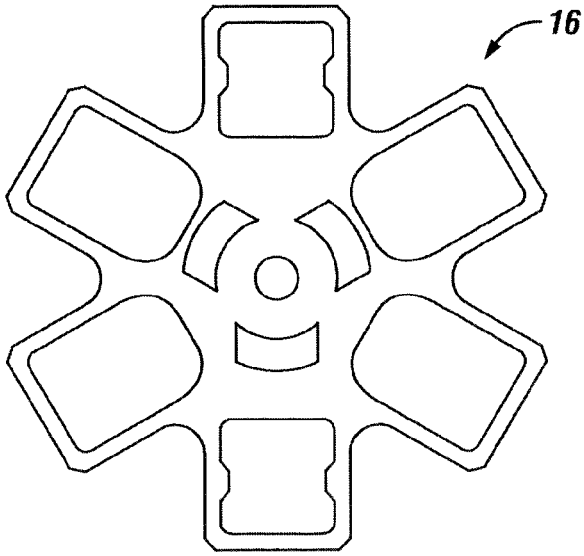
FIG. 4 is a top view of a lock ring of the invention.

FIG. 4 shows the preferred lock ring, which engages and locks fin tips. The precise shape of the lock ring is adaptive to the projectile at issue and the number of fins to be deployed. The lock ring comprises a plurality of openings which engage the fin tips until the apparatus is in its released state. The number of openings is preferably equal to the number of fins.

Figure 5:
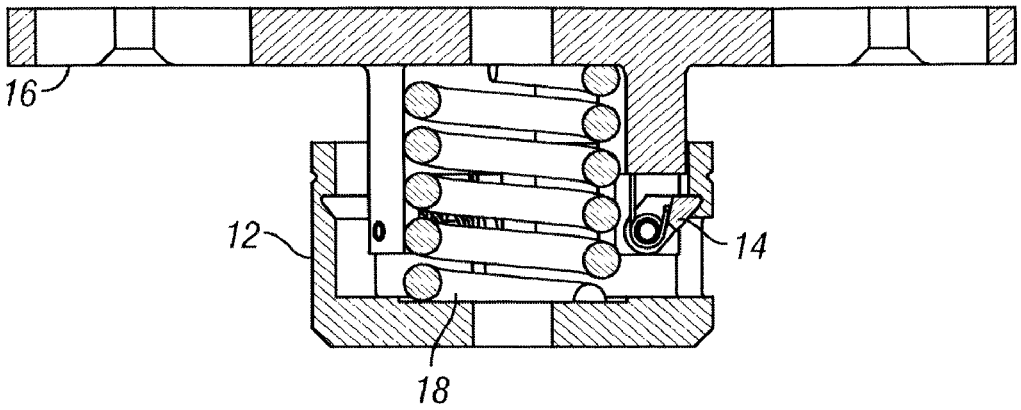
FIG. 5 is a side cut-away view of the apparatus of the invention latched state.

FIG. 5 shows the apparatus in its latched state. This is the state in which the apparatus is installed into the projectile. The fins are held in place by the lock ring, and thereby the apparatus retains fins during ground handling of the projectile. The spring maintains the latched state.

Figure 6:
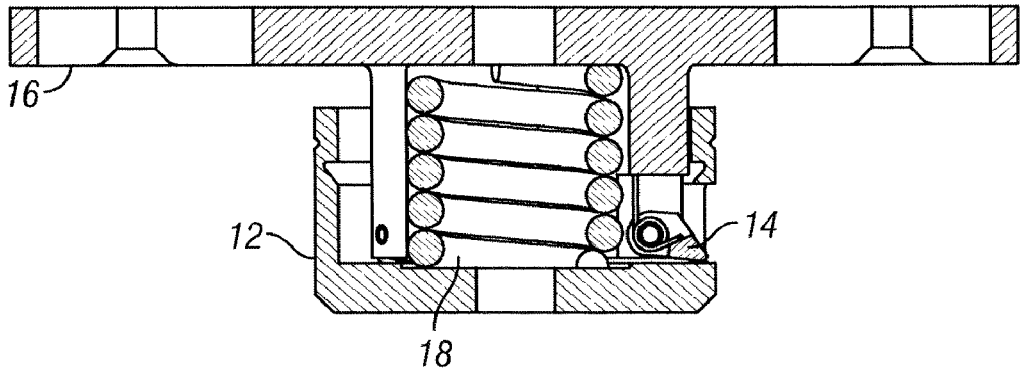
FIG. 6 is a side cut-away view of the apparatus of the invention in setback state (intermediate release state)

FIG. 6 shows the apparatus in its setback state. Gun launch setback acceleration is typically measured in the kGs. The acceleration on the lock ring compresses the large compression spring. The lock ring is driven aft, still retaining the fins. The torsion spring rotates the pawl in the window of the collar so that the apparatus is no longer latched.

Figure 7:
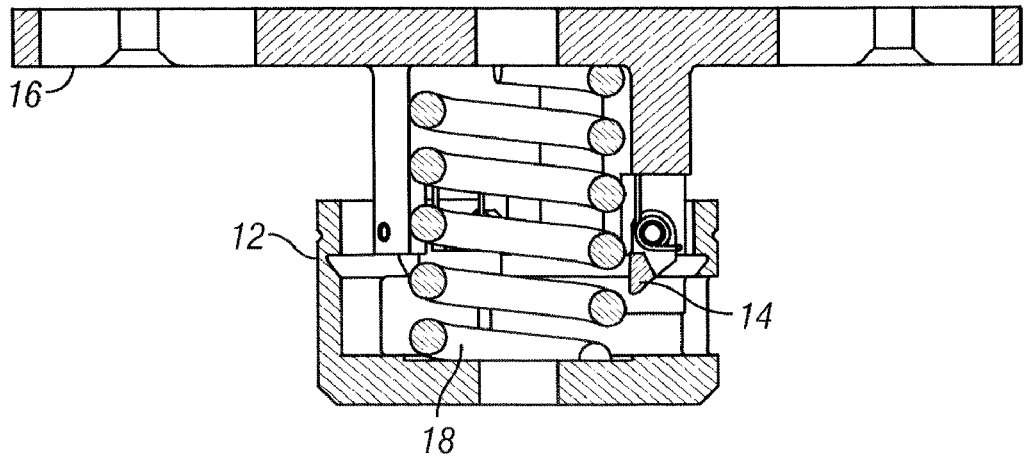
FIG. 7 is a side cut-away view of the apparatus of the invention in released state.

FIG. 7 shows the apparatus in its released state. Acceleration relieves at gun exit of the projectile. The spring drives the lock ring forward, past recovery into the latched state, thereby releasing the fin tips, whereby the fins can deploy. The spring speed ensures fin release outside of the gun tube.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. An acceleration activated fin release apparatus comprising:

a fin holder in the form of a lock ring comprising openings; and a latching mechanism comprising a primary compression spring;

wherein in a latched state, the openings in the lock ring engage tips of fins such that the fin holder holds said fins in a retracted position, and the primary spring is partially compressed and biased to expand and drive the fin holder to deploy the fins from the retracted position;

wherein the latching mechanism maintains said fin holder in the latched state, and releases the fin holder from the latched state by further compression of the primary spring following an acceleration event.

2. The apparatus of claim 1 wherein said latching mechanism comprises one or more pawls.

3. The apparatus of claim 2 wherein said latching mechanism comprises one or more secondary springs each causing release of said one or more pawls upon the acceleration event.

4. A projectile comprising retractable fins that deploy on an acceleration event, said projectile additionally comprising:

a fin holder in the form of a lock ring comprising openings;

a primary compression spring; and a latching mechanism;

wherein in a latched state, the openings in the lock ring engage tips of said fins such that the fin holder holds said fins in a retracted position, and the primary spring is partially compressed and biased to expand and drive the fin holder to deploy the fins from the retracted position; and wherein the latching mechanism maintains said fin holder in the latched state, and releases the fin holder from the latched state by further compression of the primary spring following an acceleration event.

5. The projectile of claim 4 wherein said latching mechanism comprises one or more pawls.

6. The projectile of claim 5 wherein said latching mechanism comprises one or more secondary springs causing release of said one or more pawls upon the acceleration event.

7. A method for acceleration activated fin release, the method comprising the steps of:

holding fins in a retracted position with a fin holder in the form of a lock ring having openings by engaging tips of said fins in said openings;

biasing the fin holder to deploy the fins from the retracted position with a partially compressed primary compression spring;

maintaining the fin holder and primary compression spring in a latched state with a latching mechanism; and releasing the latching mechanism by further compressing the primary spring with an acceleration event, thereby releasing the fins to a deployed state.

8. The method of claim 7 wherein said latching mechanism comprises one or more pawls.

9. The method of claim 8 wherein the latching mechanism comprises one or more secondary springs each causing release of the one or more pawls upon the acceleration event.

* * * * *